US010661570B2

(12) United States Patent
Miyashita et al.

(10) Patent No.: US 10,661,570 B2
(45) Date of Patent: May 26, 2020

(54) INK CARTRIDGE FOR REDUCTION OF INK LEAKAGE

(71) Applicant: CANON KABUSHIKI KAISHA, Tokyo (JP)

(72) Inventors: Takeho Miyashita, Yokohama (JP); Yasuo Kotaki, Yokohama (JP); Tetsuya Ohashi, Matsudo (JP); Ryoji Inoue, Kawasaki (JP); Takashi Fukushima, Yokohama (JP); Hironori Murakami, Tokyo (JP); Kyosuke Nagaoka, Kodaira (JP); Kenichi Kanno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/246,346

(22) Filed: Jan. 11, 2019

(65) Prior Publication Data

US 2019/0224978 A1 Jul. 25, 2019

(30) Foreign Application Priority Data

Jan. 22, 2018 (JP) ..... 2018-008173

(51) Int. Cl.
*B41J 2/175* (2006.01)
*B41J 2/185* (2006.01)

(52) U.S. Cl.
CPC ..... *B41J 2/17513* (2013.01); *B41J 2/17523* (2013.01); *B41J 2/17553* (2013.01); *B41J 2/17556* (2013.01); *B41J 2/17596* (2013.01); *B41J 2/185* (2013.01); *B41J 2002/17516* (2013.01)

(58) Field of Classification Search
CPC ..... B41J 2/17513; B41J 2/17523; B41J 2/17596; B41J 2/17556; B41J 2/185; B41J 2/17553; B41J 2002/17516
See application file for complete search history.

(56) References Cited

U.S. PATENT DOCUMENTS

2009/0141106 A1 6/2009 Takagi
2010/0013897 A1* 1/2010 Sulser ..... B41J 2/17513 347/86

FOREIGN PATENT DOCUMENTS

EP 1164025 A1 12/2001
EP 1380428 A2 1/2004
EP 3199358 A1 8/2017
JP 2009-255545 A 11/2009

* cited by examiner

*Primary Examiner* — Bradley W Thies
(74) *Attorney, Agent, or Firm* — Canon U.S.A., Inc. I.P. Division

(57) ABSTRACT

An ink cartridge storing ink inside the ink cartridge including an ink flow path extending from the inside where the ink is stored to outside of the ink cartridge, wherein the ink flow path includes a first opening that opens toward the outside, a second opening that opens to an opposite side of the first opening, a first valve configured to seal the first opening, a second valve configured to seal the second opening, and a biasing member connected to the first and second valves and configured to bias the first and second valves.

13 Claims, 10 Drawing Sheets

INK CARTRIDGE FOR REDUCTION OF INK LEAKAGE

BACKGROUND OF THE INVENTION

Field of the Invention

The present disclosure relates to an ink cartridge.

Description of the Related Art

As an ink cartridge for a recording apparatus such as an inkjet printer, an ink cartridge configured to be attachable to and detachable from an ink cartridge attachment portion of the recording apparatus is known. In such an ink cartridge, in a case where the ink cartridge is present alone independently of the recording apparatus (i.e., the ink cartridge is not attached to the recording apparatus), an ink supply port needs to be sealed to prevent ink from leaking from the ink supply port. On the other hand, when the ink cartridge is attached to the attachment portion of the recording apparatus, the supply port needs to open and smoothly supply ink.

Japanese Patent Application Laid-Open No. 2009-255545 discusses an ink cartridge in which a valve is biased against a sealing member by a spring, thereby sealing a supply port. This ink cartridge can reduce ink leakage in a case where the ink cartridge is present alone, and can also easily open the supply port by pressing the valve with a supply tube or the like on a recording apparatus side.

In the ink cartridge discussed in Japanese Patent Application Laid-Open No. 2009-255545, in a case where the ink cartridge is present alone as illustrated in FIG. 10, a valve 101 is pressed against a sealing member 103 by a spring 102, thereby sealing a supply port.

However, in such a configuration, in a case where a force stronger than the biasing force of the spring 102 instantaneously acts on the valve 101 by, for example, a dropping of the ink cartridge, the valve 101 can be released. As a result, there is a possibility that ink stored in the ink cartridge leaks, scatters outside of the ink cartridge, and adheres to a user or a floor.

SUMMARY OF THE INVENTION

According to an aspect of the present disclosure, an ink cartridge storing ink inside the ink cartridge includes an ink flow path extending from the inside where the ink is stored to outside of the ink cartridge, wherein the ink flow path includes a first opening that opens toward the outside, a second opening that opens to an opposite side of the first opening, a first valve configured to seal the first opening, a second valve configured to seal the second opening, and a biasing member connected to the first and second valves and configured to bias the first and second valves.

Further features of the present disclosure will become apparent from the following description of exemplary embodiments with reference to the attached drawings.

DESCRIPTION OF THE EMBODIMENTS

The present disclosure is directed to an ink cartridge having a sealing configuration in which the sealing properties of a supply port are high when the ink cartridge is present alone and which is easy to open when the ink cartridge is attached to a recording apparatus, thereby reducing the occurrence of ink leakage when the ink cartridge is impacted by dropping or the like.

Next, an ink cartridge according to the present disclosure will be specifically described with reference to the drawings. The following exemplary embodiments are examples for carrying out the present disclosure, but the present disclosure is not limited to the configurations of these exemplary embodiments. Further, parts of the contents described in the exemplary embodiments can be combined.

<Recording Apparatus>

Figure 1:
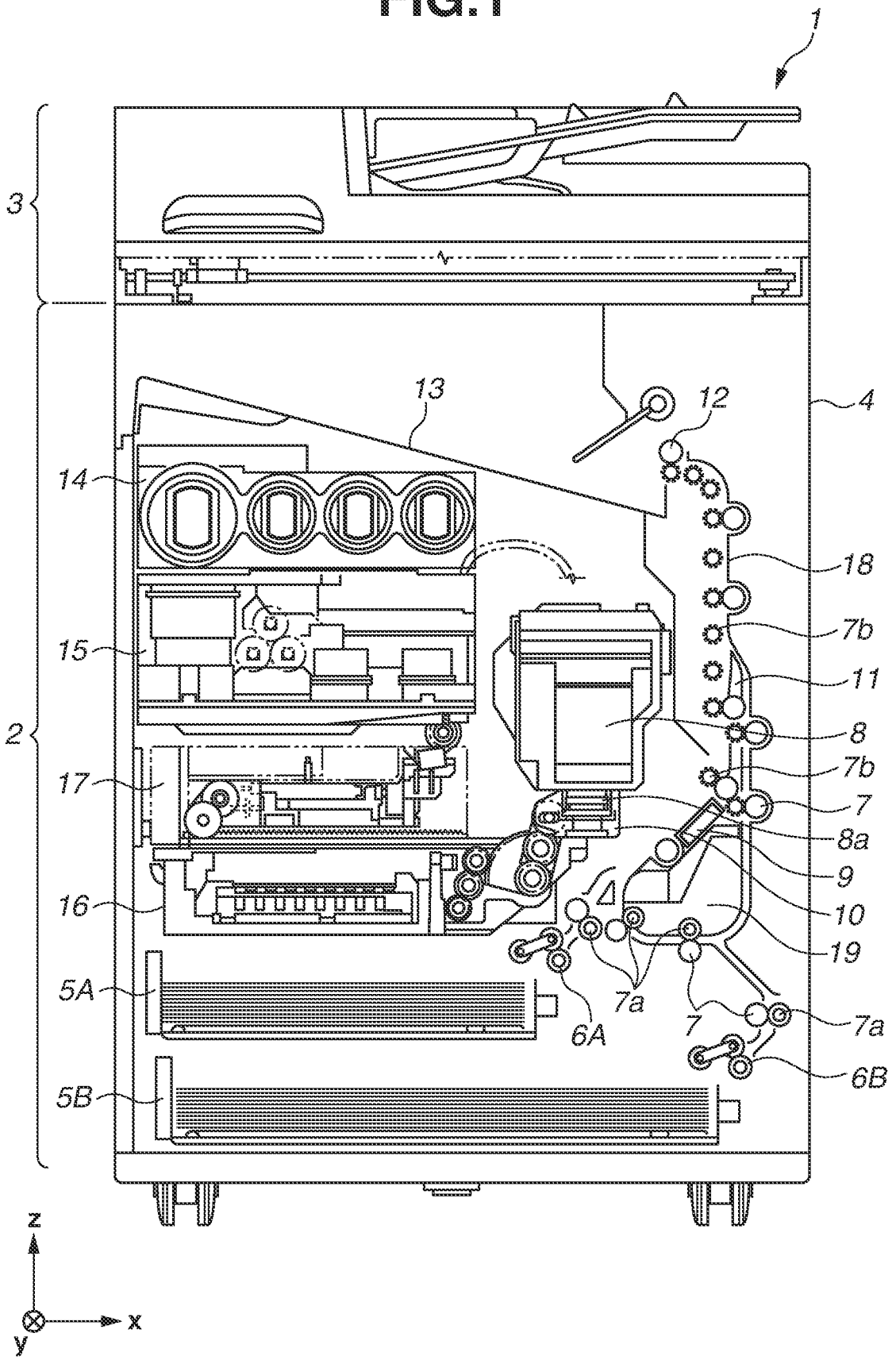
FIG. 1 is a diagram illustrating an inkjet printer.

First, with reference to FIG. 1, a description is given of the overall configuration of an inkjet printer 1 (hereinafter, a "recording apparatus 1"), which is an example of a recording apparatus to which the ink cartridge according to the present disclosure is attached. FIG. 1 is a diagram illustrating an internal configuration of the recording apparatus 1. In FIG. 1, an x-direction represents the horizontal direction, a y-direction (a direction perpendicular to the plane of the paper) represents the direction in which discharge ports are arranged in a recording head 8, and a z-direction represents the gravity (vertical) direction. The x-direction, the y-direction, and the z-direction illustrated in FIG. 1 are used with similar meanings also in the drawings following FIG. 1. For example, an x-direction, a y-direction, and a z-direction illustrated in FIGS. 2A and 2B coincide with the x-direction, the y-direction, and the z-direction, respectively, illustrated in FIG. 1.

The recording apparatus 1 is a multifunction peripheral including a printing unit 2 and a scanner unit 3 above the printing unit 2. The printing unit 2 and the scanner unit 3 can individually or cooperatively execute various processes regarding a recording operation and a reading operation. The scanner unit 3 includes an auto document feeder (ADF) and a flatbed scanner (FBS). The scanner unit 3 can read a document that is automatically fed by the ADF and read (scan) a document on a document platen of the FBS placed by a user. In a first exemplary embodiment, the multifunction peripheral including both the printing unit 2 and the scanner unit 3 is employed as an example. Alternatively, a recording apparatus not including the scanner unit 3 may be employed. FIG. 1 illustrates a state where the recording apparatus 1 is in a standby state where the recording apparatus 1 is not performing neither the recording operation nor the reading operation.

In the printing unit 2, a first cassette 5A and a second cassette 5B for storing recording media (cut sheets) S are detachably installed in a bottom portion of a housing 4, which is on the lower side in the gravity direction. In the first cassette 5A, relatively small recording media up to A4 size are flatly stored. In the second cassette 5B, relatively large recording media up to A3 size are flatly stored. Near the first cassette 5A, a first feeding unit 6A is provided, which separates the recording media stored in the first cassette 5A one by one and feeds each recording medium. Similarly, near the second cassette 5B, a second feeding unit 6B is provided. When the recording operation is performed, the recording medium S is selectively fed from either one of the cassettes.

A conveyance mechanism for guiding the recording medium S in a predetermined direction includes conveyance rollers 7, a discharge roller 12, pinch rollers 7*a*, spurs 7*b*, a guide 18, an inner guide 19, and a flapper 11. The conveyance rollers 7 are driving rollers that are disposed upstream and downstream of a recording head 8 and driven by a conveyance motor (not illustrated). The pinch rollers 7*a* are driven rollers that rotate while nipping the recording medium S with the conveyance rollers 7. The discharge roller 12 is a driving roller that is disposed downstream of the conveyance rollers 7 and driven by a conveyance motor (not illustrated). The spurs 7*b* convey the recording medium S while nipping the recording medium S with the conveyance rollers 7 disposed downstream of the recording head 8 and with the discharge roller 12.

The guide 18 is provided in the conveyance path of the recording medium S and guides the recording medium S in the predetermined direction. The inner guide 19 includes a side surface that extends in the y-direction and is curved. The inner guide 19 guides the recording medium S along the side surface. The flapper 11 is used for switching the direction in which the recording medium S is conveyed when a two-sided recording operation is performed. A discharge tray 13 is a tray for stacking and holding the recording medium S on which the recording operation is completed and which is discharged by the discharge roller 12.

The recording head 8 according to the present exemplary embodiment is a full-line type color inkjet recording head. In the recording head 8, a plurality of discharge ports for discharging ink according to data for recording are arranged across a width corresponding to the width of the recording medium S along the y-direction in FIG. 1. When the recording head 8 is at a standby position, a discharge port surface 8*a* of the recording head 8 is capped by a cap unit 10 as illustrated in FIG. 1. When the recording operation is performed, the direction of the recording head 8 is changed by a print controller so that the discharge port surface 8*a* is opposed to a platen 9. The platen 9 is composed of a flat plate extending in the y-direction and supports, from the back surface of the recording medium S, the recording medium S on which the recording operation is performed by the recording head 8.

The recording head 8 may not need to be a full-line type recording head, and may be a serial scanning type recording head that moves the head back and forth in a direction intersecting the conveyance direction of the recording medium S.

An attachment portion 14 is a portion to which ink cartridges are attached. The attachment portion 14 may be detachable from the recording apparatus 1. In this case, an example is illustrated where four ink cartridges are attached to the attachment portion 14, and each ink cartridge stores any one of four colors of ink to be supplied to the recording head 8. An ink supply unit 15 is provided in the middle of a flow path connecting the attachment portion 14 and the recording head 8, and adjusts the pressure and the flow rate of ink in the recording head 8 to be in appropriate ranges. In the present exemplary embodiment, a circulating ink supply system is employed, and the ink supply unit 15 adjusts the pressure of ink to be supplied to the recording head 8 and the flow rate of ink to be collected from the recording head 8 to be in appropriate ranges.

A maintenance unit 16 includes the cap unit 10 and a wiping unit 17. The maintenance unit 16 causes the cap unit 10 and the wiping unit 17 to operate at a predetermined timing, thereby performing a maintenance operation on the recording head 8.

In the specification, "ink" includes any liquid that is applied to a recording medium and thereby can be used for forming an image or processing the recording medium. In other words, "ink" in the specification is a concept including any liquid that can be used for recording. Further, concept of recording is not particularly limited, and is also applicable to industrial use. For example, the concept of recording can also be used for producing a biochip, printing an electronic circuit, and producing a semiconductor substrate. The ink cartridge is a container for storing the ink.

Figure 2A:
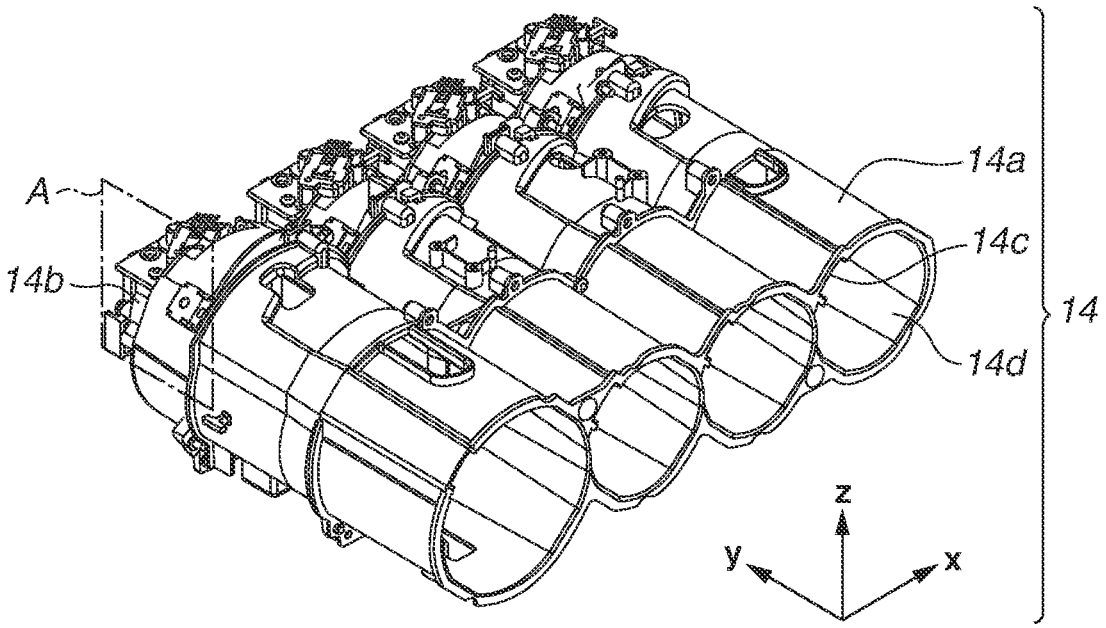
FIGS. 2A and 2B are diagrams illustrating an attachment portion.
Figure 2B:
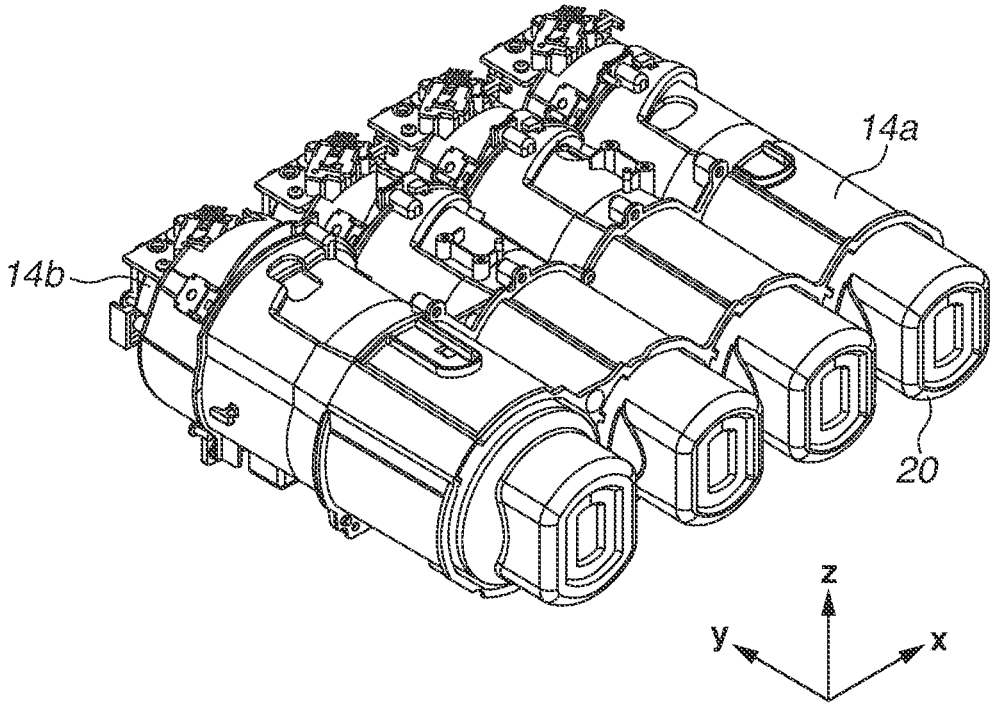

FIGS. 2A and 2B are diagrams of the attachment portion 14 seen from obliquely above in the gravity direction when the attachment portion 14 is taken out of the recording apparatus 1 illustrated in FIG. 1. FIG. 2A is a diagram illustrating a state before ink cartridges are attached to the attachment portion 14. FIG. 2B is a diagram illustrating a state after ink cartridges 20 are attached to the attachment portion 14.

The attachment portion 14 illustrated in FIGS. 2A and 2B includes four cylindrical hole forming members 14*a*. Each hole forming member 14*a* forms a hole 14*d*. The ink cartridge 20 is inserted into the hole 14*d* formed by the hole forming member 14*a* of the attachment portion 14, thereby being attached to the attachment portion 14 of the recording apparatus 1. A plurality of hole forming members 14*a* do not necessarily need to be provided. For example, a single hole forming member may form a plurality of holes. It is desirable that the diameter of the hole 14*d* (the diameter in a direction orthogonal to the extending direction of the hole 14*d*) should be 50 mm or more and 90 mm or less. In a case where the diameter in the direction orthogonal to the extending direction of the hole 14*d* is not based on a true circle, the diameter of the hole 14*d* is an equivalent circular diameter.

On the back side of the hole forming member 14*a*, a hole forming member 14*b* different from the hole forming member 14*a* is provided. When the ink cartridge 20 is attached, the hole forming member 14*a* is on the front side, and the hole forming member 14*b* is on the back side. A hole (not illustrated in FIGS. 2A and 2B) is formed also in the hole forming member 14*b*, and the hole 14*d* of the hole forming member 14*a* and the hole of the hole forming member 14*b* communicate with each other inside the attachment portion 14. The ink cartridge 20 is inserted into a hole formed with this communication. The hole forming member 14*a* and the hole forming member 14*b* may not need to be provided as different members. For example, a member in which two hole forming members are integrated may be used. Examples of a material forming the hole forming member 14*a* include an acrylonitrile butadiene styrene (ABS) copolymer resin, polyphenylene oxide (PPO) (Noryl), and a high impact polystyrene (HIPS) resin. Examples of a material forming the hole forming member 14*b* include polypropylene (PP), polyethylene (PE), and PPO.

In an opening on the front side of the hole 14*d* of the hole forming member 14*a*, an identification (ID) recessed portion 14*c* is provided. The ID recessed portion 14*c* is used to roughly align the ink cartridge 20 relative to the attachment portion 14 when the ink cartridge 20 is attached. In FIG. 2A, a circular opening of the hole 14*d* is partially recessed, thereby forming the ID recessed portion 14*c* having a recessed shape.

Further, in the attachment portion 14, a plurality of electrical connection portions (not illustrated in FIGS. 2A and 2B) are provided, which come into contact with a plurality of pad electrodes included in the ink cartridge 20 and electrically connect to the pad electrodes by the contact. In FIGS. 2A and 2B, the electrical connection portions are provided in the hole forming member 14*b* of the attachment portion 14.

Figure 3:
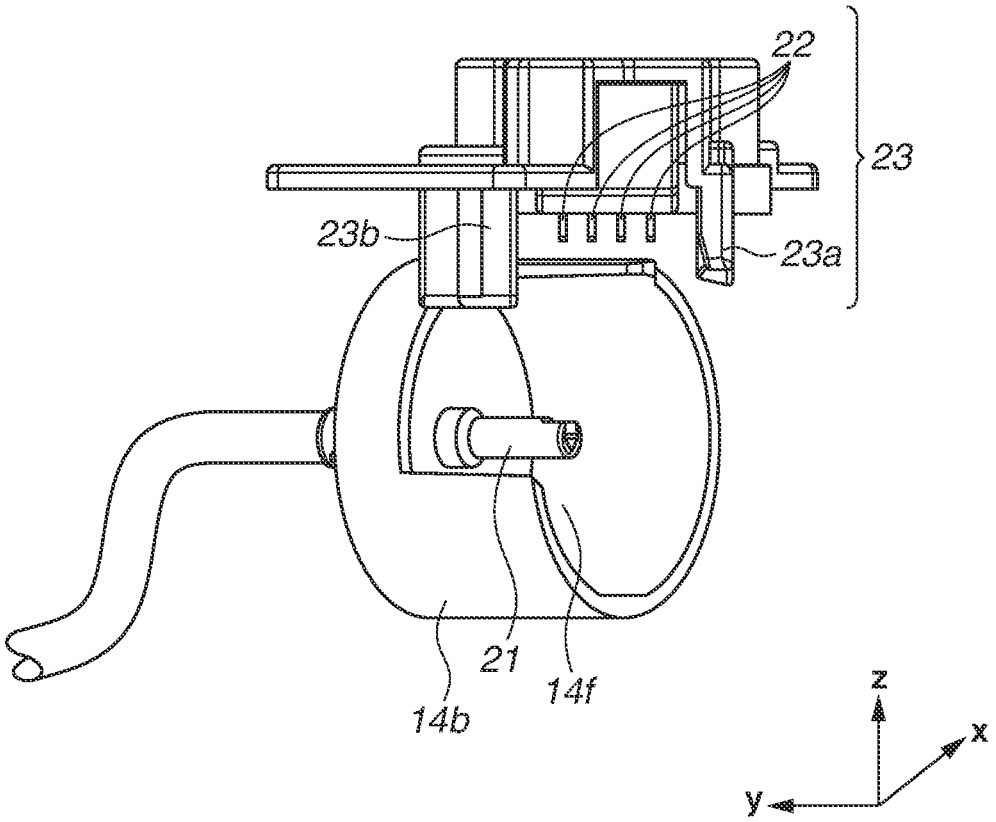
FIG. 3 is a diagram illustrating a configuration around electrical connection portions of the attachment portion.
Figure 4A:
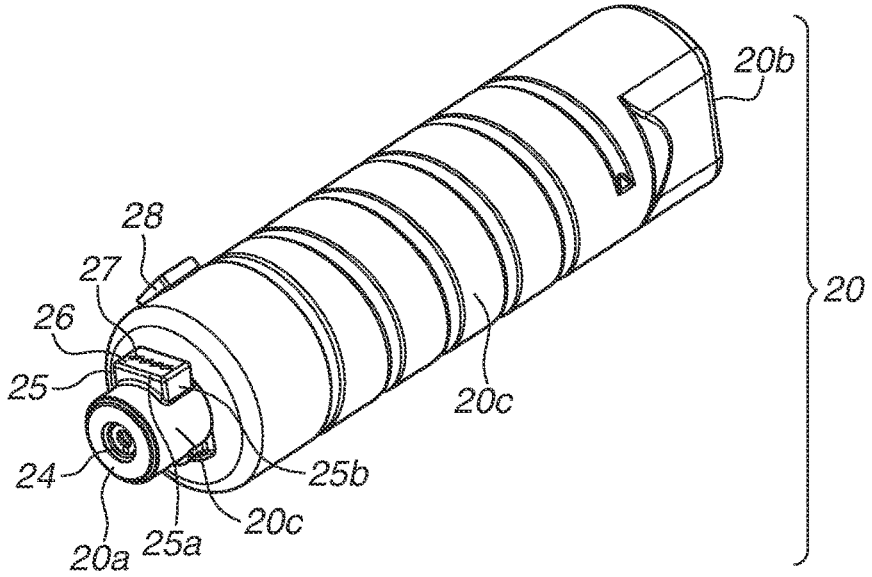
FIGS. 4A, 4B, 4C, and 4D are diagrams illustrating an external appearance of an ink cartridge.
Figure 4B:
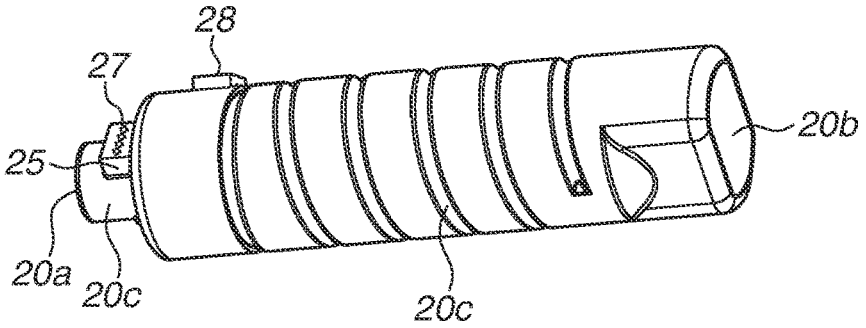
Figure 4C:
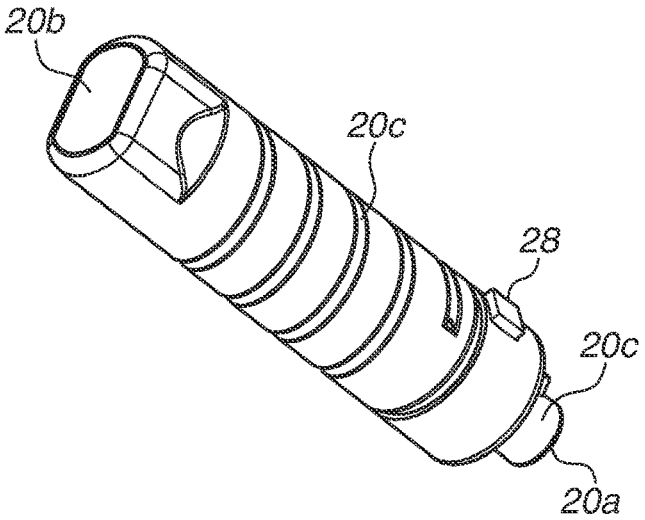
Figure 4D:
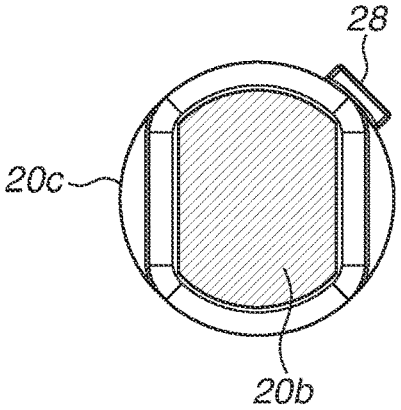

FIG. 3 schematically illustrates an enlarged view around the electrical connection portions included in the hole forming member 14*b* of the attachment portion 14. FIG. 3 is a diagram illustrating a cross section of the attachment portion 14 at a portion A surrounded by dashed-dotted lines in FIG. 2A. In FIG. 3, a part of the attachment portion 14 including the hole forming member 14*a* is omitted. As illustrated in FIG. 3, the hole forming member 14*b* forms a hole 14*f*. From the surface on the back side of the hole 14*f* (the bottom surface of the hole 14*f* formed by the hole forming member 14*b*), a tubular ink reception tube 21 protrudes. The surface on the back side of the hole 14*f* has a circular shape, and the ink reception tube 21 protrudes from the center of the circle in a direction perpendicular to the surface on the back side of the hole 14*f* (the extending direction). The ink reception tube 21 is a tube for receiving ink supplied from the ink cartridge 20 attached to the attachment portion 14. The ink reception tube 21 is connected to the recording head 8 of the recording apparatus 1 through an ink flow path and supplies the ink received from the ink cartridge 20 to the recording head 8. A single ink reception tube corresponds to an ink of a single color. Thus, it is desirable to provide as many ink reception tubes as ink colors to be used. Examples of a material forming the ink reception tube 21 include SUS (stainless steel) and PPO. It is desirable that the diameter of the ink reception tube 21 (the diameter at a cross section orthogonal to the extending direction of the ink reception tube 21) should be 2 mm or more and 5 mm or less. It is more desirable that the diameter of the ink reception tube 21 should be 3 mm or more and 4 mm or less. It is desirable that the diameter of the hole 14*f* (the diameter in a direction orthogonal to the extending direction of the hole 14*f*) should be 20 mm or more and 30 mm or less. It is desirable that the diameter of the hole 14*f* should be smaller than the diameter of the hole 14*d*. It is more desirable that the diameter of the hole 14*f* should be 40% or more and 50% or less of the diameter of the hole 14*d*.

<Ink Cartridge>

FIGS. 4A to 4D are diagrams illustrating an external appearance of the ink cartridge 20 seen from various angles. The ink cartridge 20 illustrated in FIGS. 4A to 4D is formed based on a housing having a columnar (cylindrical) shape. The shape of the housing is not limited to a columnar shape, and for example, may be a polygonal columnar shape such as a triangular prism shape or a quadrangular prism shape. Alternatively, the shape of the housing may be a circular cone shape or a polygonal pyramid shape such as a triangular pyramid shape or a quadrangular pyramid shape.

The ink cartridge 20 includes, as portions of the ink cartridge 20 that face outward, at least a first portion 20*a*, a second portion 20*b*, and a third portion 20*c*. A portion on the side where an insertion portion 24 is located is the first portion 20*a*. A portion on the opposite side of the first portion 20*a* is the second portion 20*b*. Then, the first portion 20*a* and the second portion 20*b* are connected by the third portion 20*c*. The third portion 20*c* is located between the first portion 20*a* and the second portion 20*b*. In FIGS. 4A to 4D, the third portion 20*c* is orthogonal to the first portion 20*a* and the second portion 20*b*. The first portion 20*a*, the second portion 20*b*, and the third portion 20*c* may be surfaces as illustrated in FIGS. 4A to 4D. Alternatively, at least one of the first portion 20*a*, the second portion 20*b*, and the third portion 20*c* may not be a surface. For example, in a case where the ink cartridge 20 has a triangular pyramid shape, the first portion 20*a* can be the bottom surface of the triangular pyramid, the second portion 20*b* can be an apex on (above) the bottom surface of the triangular pyramid, and the third portion 20*c* can be the side surfaces of the triangular pyramid. In this case, the second portion 20*b* is an apex, not a surface.

In the first portion 20*a*, the insertion portion 24 is located, into which the ink reception tube 21 illustrated in FIG. 3 is inserted. Thus, the first portion 20*a* can also be said to be a front portion of the housing. In FIGS. 4A to 4D, the first portion 20*a* is a surface. As described below, a sealing member including an opening is provided in the insertion portion 24, and the ink reception tube 21 is inserted into the opening included in the sealing member of the insertion portion 24. It is desirable that the diameter of the insertion portion 24 (the diameter in a direction orthogonal to the direction from which the ink reception tube 21 is inserted) should be 2 mm or more and 5 mm or less.

The ink cartridge 20 stores ink inside the ink cartridge 20. The stored ink is supplied to the recording apparatus 1 through the ink reception tube 21 inserted into the insertion portion 24 (if the sealing member is present, the opening of the sealing member) and is used for recording.

The ink cartridge 20 includes a larger diameter portion having a relatively large diameter and a smaller diameter portion having a relatively smaller diameter than the larger diameter portion. The ink cartridge 20 in FIGS. 4A to 4D has a columnar shape, and a "diameter" in this case is the diameter of a circle at a cross section along a direction perpendicular to the height direction of the column. A portion of the smaller diameter portion on the side where the insertion portion 24 is located is the first portion 20*a*. The second portion 20*b* is provided in the larger diameter portion. The third portion 20*c*, which connects the first portion 20*a* and the second portion 20*b*, is a surface spanning the larger diameter portion and the smaller diameter portion and having a difference in level between the larger diameter portion and the smaller diameter portion. The diameter of the ink cartridge 20 may be constant along the longitudinal direction of the column, and the ink cartridge 20 may have a shape in which the third portion 20*c* has no difference in level. The ink cartridge 20 illustrated in FIGS. 4A to 4D has a columnar shape, the first portion 20*a* and the second portion 20*b* are the bottom surfaces of the column, and the third portion 20*c* is the side surface of the column. As described above, the ink cartridge 20 is not limited to a columnar shape. The ink cartridge 20 may have a shape in which the first portion 20*a* or the second portion 20*b* has a difference in level.

It is desirable that the diameter of the larger diameter portion of the ink cartridge 20 should be 50 mm or more and 80 mm or less. It is desirable that the diameter of the smaller diameter portion of the ink cartridge 20 should be 20 mm or more and 30 mm or less. The diameter of the ink cartridge 20 can be varied according to the amount or the type of the ink stored in the ink cartridge 20. For example, in a certain ink cartridge set, the diameter of the larger diameter portion of a large-capacity ink cartridge can be 70 mm or more and 80 mm or less, and the diameter of the larger diameter portion of a small-capacity ink cartridge can be 50 mm or more and 60 mm or less. Even in this case, however, in terms of attachment, it is desirable to make the diameters of the smaller diameter portions of the ink cartridges uniform. That is, in an ink cartridge set in which the amounts and the types of inks stored in ink cartridges are different from each other, it is desirable that the diameters of the smaller diameter portions of the ink cartridges should be the same as each other, and the diameters of the larger diameter portions of the ink cartridges should be different from each other.

It is desirable that the length of the larger diameter portion of the ink cartridge 20 should be 190 mm or more and 220 mm or less. It is desirable that the length of the smaller diameter portion of the ink cartridge 20 should be 20 mm or more and 30 mm or less. The lengths of the larger diameter portion and the smaller diameter portion are lengths in a direction parallel to the direction from the first portion 20*a* to the second portion 20*b* of the ink cartridge 20. In terms of attachment, even in a case where the amounts or the types of inks stored in ink cartridges are different from each other as in the case of above ink cartridge set, it is desirable to make the lengths of the larger diameter portions and the smaller diameter portions of the ink cartridges 20 uniform. The direction from the first portion 20*a* to the second portion 20*b* of the ink cartridge 20 is the direction of the shortest line connecting the first portion 20*a* and the second portion 20*b*. In FIGS. 4A to 4D, this direction coincides with the longitudinal direction of the ink cartridge 20.

Next, a protruding portion 25 and an ID projection portion 28 are described. The protruding portion 25 and the ID projection portion 28 are provided in the third portion 20*c*. In FIGS. 4A to 4D, the protruding portion 25 is located on a portion of the smaller diameter portion in the third portion 20*c*, and protrudes further than a portion around the protruding portion 25 that forms the third portion 20*c*. The portion around the protruding portion 25 is the side surface of a column, and the protruding portion 25 protrudes from the side surface of the column. The protruding portion 25 includes a ceiling surface 25*a*, which is the ceiling of the protruding portion 25, and protruding portion side surfaces 25*b*. There are four protruding portion side surfaces 25*b*, and the ceiling surface 25*a* connect the protruding portion side surfaces 25*b* on the upper side. On the ceiling surface 25*a*, an electrode portion 26 is provided. On the electrode portion 26, a plurality of pad electrodes 27 are provided, which come into contact with the electrical connection portions of the recording apparatus 1 (the attachment portion 14), to electrically connect to the electrical connection portions. The ceiling surface 25*a* is a portion of the ink cartridge 20 that faces outward, and is a part of a portion connecting the first portion 20*a* and the second portion 20*b*. Thus, the ceiling surface 25*a* is a part of the third portion 20*c*. Thus, the electrode portion 26 and the plurality of pad electrodes 27 on the ceiling surface 25*a* are provided in the third portion 20*c*. The electrode portion 26 may be composed only of the pad electrodes 27. In this case, the pad electrodes 27 are directly placed on the ceiling surface 25*a* of the protruding portion 25.

The ID projection portion 28 protrudes at the larger diameter portion in the third portion 20*c*. The ID projection portion 28 also protrudes further than a portion around the ID projection portion 28. The portion around the ID projection portion 28 is the side surface of a column, and the ID projection portion 28 protrudes from the side surface of the column.

Examples of a material forming a portion of the housing of the ink cartridge 20 particularly on the second portion 20*b* side include PE and PP. Examples of a material forming the protruding portion 25 include PE and PP, similarly to the housing. Examples of a material forming the electrode portion 26 include flexible printing plates made of a glass epoxy and a polyimide. Examples of a material forming the pad electrodes 27 include Ni and Au. Examples of a material forming the ID projection portion 28 include PE and PP, similarly to the housing.

Figure 5A:
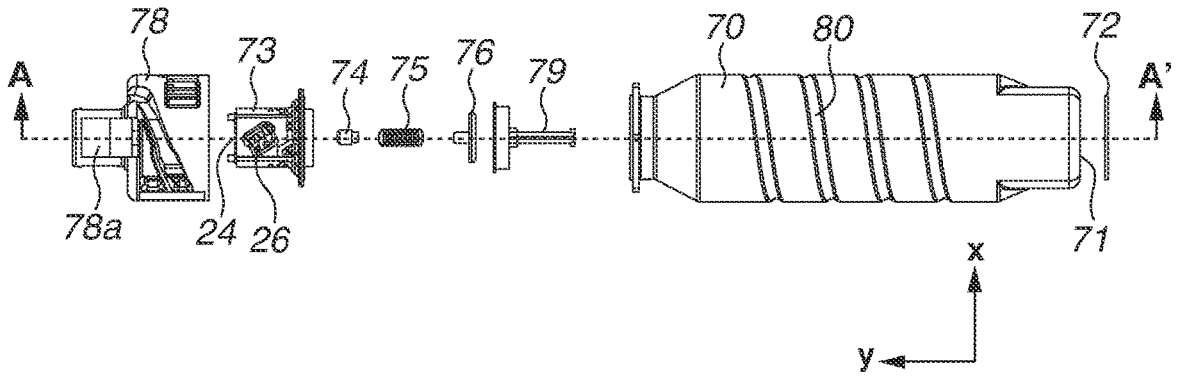
FIGS. 5A, 5B, and 5C are an exploded view and cross-sectional views of the ink cartridge.
Figure 5B:
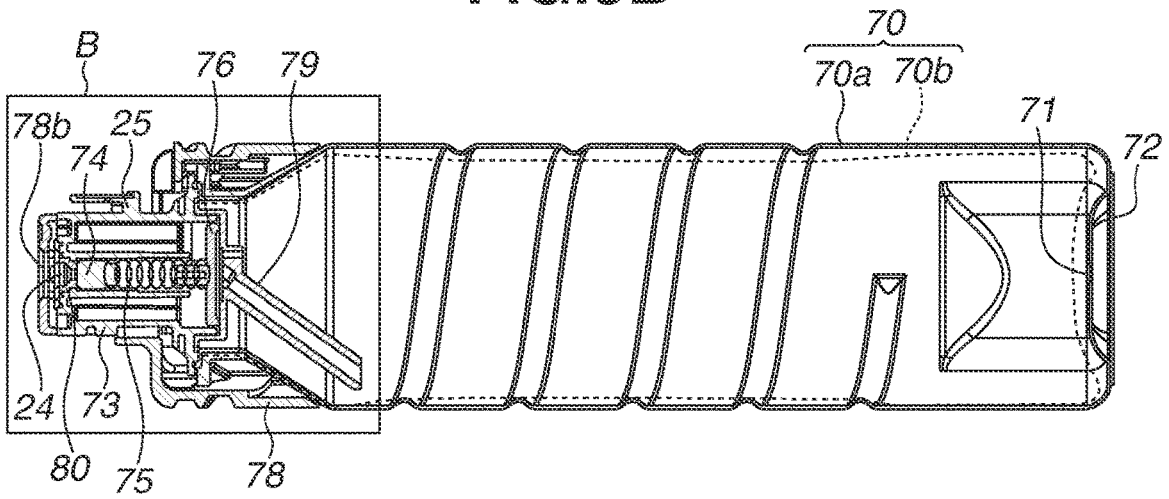

FIGS. 5A and 5B illustrate the internal configuration of the ink cartridge 20. FIG. 5A is an exploded view of the ink cartridge 20. FIG. 5B is a cross-sectional view taken along A-A' in FIG. 5A in the state where components illustrated in FIG. 5A are combined. A housing 70 has a two-layer structure including an outer layer 70*a* and an inner layer 70*b*. The outer layer 70*a* is an outside layer indicated by a solid line. It is desirable that the outer layer 70*a* should be formed of a material having high stiffness. On the other hand, the inner layer 70*b* is an inside layer indicated by a dotted line. It is desirable that the inner layer 70*b* should be formed of a flexible material. In other words, it is desirable that the outer layer 70*a* should have higher stiffness than the inner layer 70*b*. The outer layer 70*a* and the inner layer 70*b* can separate from each other, and ink is stored within (inside) the inner layer 70*b*. The outer layer 70*a* and the inner layer 70*b* include openings at the same portions. The opening of the inner layer 70*b* is joined to a joint member 73, thereby forming a closed space. The ink is stored in the closed space. It is desirable that the outer layer 70*a* and the inner layer 70*b* should be molded by injection blow. Examples of a material forming the outer layer 70*a* include polyethylene terephthalate (PET) and polybutylene terephthalate (PBT). Examples of a material forming the inner layer 70*b* include PE and PP.

Figure 5C:
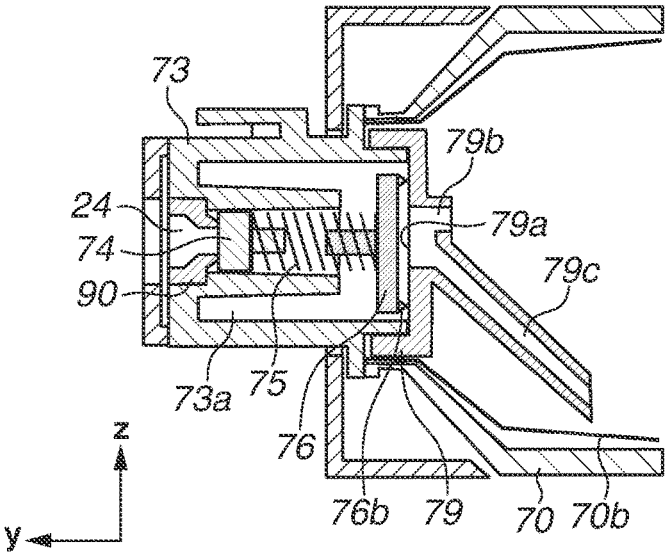

The housing 70 is joined to a cover member 78. The housing 70 forms a part of the larger diameter portion of the ink cartridge 20. The cover member 78 forms a part of the larger diameter portion and the smaller diameter portion of the ink cartridge 20. In the smaller diameter portion of the cover member 78, an insertion portion 24 is provided. Examples of a material forming the cover member 78 include PE, PP, and ABS. It is desirable that the length of the cover member 78 should be 60 mm or more and 80 mm or less. It is more desirable that the length of the cover member 78 should be 60 mm or more and 70 mm or less. The length of the cover member 78 is the length in a left-right direction in FIG. 5A. Further, if the ink cartridge 20 has a shape as illustrated in FIGS. 5A to 5C the length of the cover member 78 is the length in a direction along the longitudinal direction of the ink cartridge 20.

The housing 70 includes a screw-shaped groove 80 in the outer layer 70*a*. The screw-shaped groove 80 makes the strength of the housing 70 higher. The groove 80 may be a single groove, or may be a plurality of grooves that are not connected to each other. In terms of the strength of the housing 70, it is desirable that the extending direction of the groove 80 should be a direction inclined relative to the longitudinal direction of the ink cartridge 20.

The ink cartridge 20 supplies ink to the outside (the recording apparatus 1) of the ink cartridge 20, and if the amount of ink stored in the ink cartridge 20 decreases, the inner layer 70*b* deforms according to the volume of the decrease in the ink. When the ink stored in the ink cartridge 20 is eventually used up, the inner layer 70*b* becomes crushed. On the other hand, in a case where the outer layer 70*a* is formed of a material having high stiffness, the outer layer 70*a* is less likely to deform and maintains its shape. In the housing 70, an atmosphere communicating port 71 opens in the second portion 20*b* of the ink cartridge 20. Atmosphere is introduced into a space between the outer layer 70*a* and the inner layer 70*b* through the atmosphere communicating port 71. The atmosphere communicating port 71 is covered except for its small portion by a label 72, whereby it is possible to excellently reduce the evaporation of ink. Examples of a material forming the label 72 include PP film and paper.

The joint member 73 includes the insertion portion 24. At the front end of the insertion portion 24, the ink reception tube 21 is inserted. Thus, in a case where the joint member 73 is provided, the joint member 73 forms at least a part of the first portion 20*a* of the ink cartridge 20. In the joint member 73, the protruding portion 25 is provided, and on the protruding portion 25, the electrode portion 26 is provided. Further, the joint member 73 enters the inside of the cover member 78, the protruding portion 25 is exposed to outside through an opening 78*a* of the cover member 78, and the insertion portion 24 is exposed to outside through the opening 78*b* of the cover member 78. In this case, the joint member 73 forms a part of the first portion 20*a* and a part of the third portion 20*c* of the ink cartridge 20.

The configurations of the joint member 73 and the periphery of the joint member 73 are described in detail. FIG. 5C illustrates an enlarged view of a portion indicated by B in FIG. 5B. To the housing 70 side of the joint member 73, a flow path member 79 is joined, which supplies ink from the housing 70 to the joint member 73 side. The joint member 73 and the flow path member 79 are joined together by, for example, press fit or welding. A space within the joint member 73 formed by the joint member 73 and the flow path member 79 is an ink flow path (an ink supply portion 73*a*). Between the joint member 73 and the flow path member 79, a flow path opening 79*a* opens, which supplies ink stored in the housing 70 to the inside of the ink supply portion 73*a*. As described below, in a case where the ink cartridge 20 is not attached to the recording apparatus 1, the flow path opening 79*a* is sealed from the ink supply portion 73*a* side by being biased by a second valve 76. As illustrated in FIG. 5C, in the flow path member 79, an upper flow path 79*b* and a lower flow path 79*c* are provided, each of which communicates with the flow path opening 79*a*. The upper flow path 79*b* and the lower flow path 79*c* are provided, whereby it is possible to supply ink in an upper portion of the housing 70, which is on the upper side in the vertical direction, and ink in a lower portion (a bottom portion) of the housing 70, which is on the lower side in the vertical direction, as uniformly as possible. Thus, for example, in a case where a pigment ink is used, it is possible to supply the ink by evening out the pigment concentration distribution in the up-down direction due to pigment precipitation in the housing 70.

The insertion portion 24 is an opening (a first opening). This opening is formed by a sealing portion 90. The sealing portion 90 may be molded integrally with the joint member 73, or may be separated from the joint member 73. In a case where the ink cartridge 20 is not attached to the recording apparatus 1, a first valve 74 is biased against the sealing portion 90 by a spring 75, which is a biasing member, and caused to abut the sealing portion 90, thereby sealing the opening of the insertion portion 24. Examples of a material forming the sealing portion 90 include a rubber and an elastomer. In terms of stability, it is desirable to use a spring as the biasing member as illustrated in the present exemplary embodiment. It is more desirable to use a spring formed of SUS (stainless steel). Alternatively, an elastic body such as a rubber may be used as the biasing member.

At the end of the spring 75 on the opposite side of the side where the opening of the insertion portion 24 of the spring 75 is sealed, i.e., the end of the spring 75 on the housing 70 side, the second valve 76 is placed. Similarly to the first valve 74, the second valve 76 is connected to the spring 75 and biased by the spring 75. The second valve 76 includes a lip 76*b* in an outer peripheral portion on the surface of the second valve 76 on the opposite side of the surface on the side where the second valve 76 is connected to the spring 75. Except when ink is supplied to the recording apparatus 1, the second valve 76 is biased to the flow path member 79 side by the spring 75. Consequently, the lip 76*b* abuts a surface 79*d* of the flow path member 79 on the ink supply portion 73*a* side, the flow path opening 79*a* of the flow path member 79 is sealed from the ink supply portion 73*a* side, and a portion between the ink supply portion 73*a* and the housing 70 is closed.

Figure 6A:
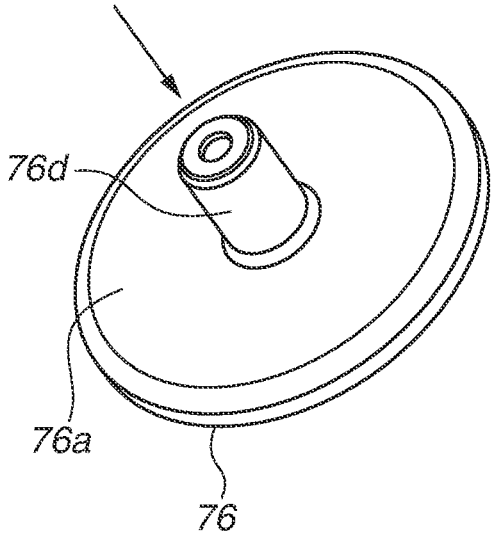
FIGS. 6A, 6B, 6C, and 6D are perspective views illustrating a second valve.
Figure 6B:
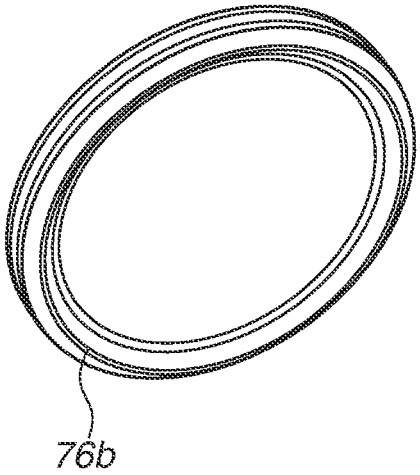

FIGS. 6A and 6B are a perspective view of the second valve 76 seen from the insertion portion 24 side of the joint member 73 (FIG. 6A), and a perspective view of the second valve 76 seen from the housing 70 side (FIG. 6B). As illustrated in FIG. 6A, if the surface of the second valve 76 on the side where the second valve 76 is connected to the spring 75 is a spring connection surface 76*a*, a spring supporting portion 76*d* for supporting the spring 75 is located at the center of the spring connection surface 76*a*. On the opposite side of the spring connection surface 76*a*, the lip 76*b* is provided.

Figure 6C:
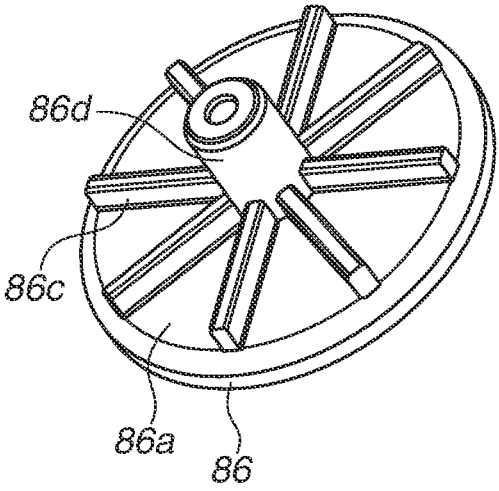
Figure 6D:
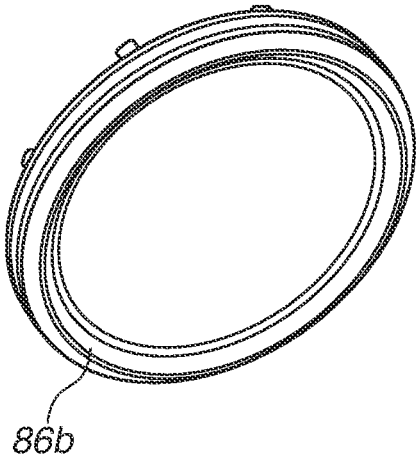

FIGS. 6C and 6D illustrate another example of the second valve 76. A second valve 86 illustrated in FIGS. 6C and 6D has higher sealing properties than the second valve 76 illustrated in FIGS. 6A and 6B. In the second valve 86 illustrated in FIGS. 6C and 6D, a rib 86*c* is provided from a spring supporting portion 76*d* to the outer periphery of the second valve 86 on a spring connection surface 86*a*. With the rib 86*c*, the deformation of the spring connection surface 86*a* is reduced, and the load of the spring 75 is efficiently transmitted to a lip 86*b*, whereby it is possible to further improve the sealing properties. It is desirable to provide a plurality of ribs 86*c*. In this case, it is desirable to provide the ribs 86*c*, radiating from the spring supporting portion 86*d* provided at the center.

Alternatively, in the second valve, for example, only the lip can be formed of a flexible material such as an elastomer or a rubber, and the other portion can be formed of PP or PE. Also by forming the second valve by such two-color molding method, it is possible to improve the sealing properties.

Figure 7A:
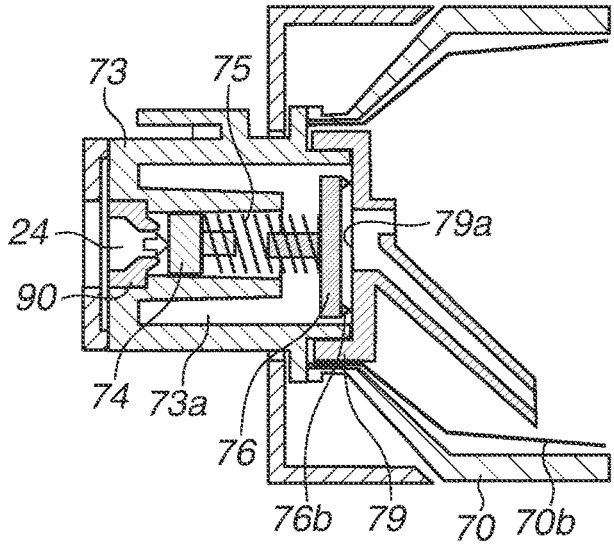
FIGS. 7A, 7B, and 7C are cross-sectional views of the ink cartridge.

The sealing configuration according to the present disclosure is further described. The ink cartridge according to the present exemplary embodiment stores ink inside the ink cartridge. The ink cartridge includes an ink flow path (the ink supply portion 73*a*) extending from the inside to the outside of the ink cartridge. The ink flow path includes a first opening (the opening of the insertion portion 24) that opens toward the outside of the ink cartridge, and a first valve 74 that seals the first opening. Further, the ink cartridge includes a second opening (the flow path opening 79*a*) that opens to the opposite side of the first opening, and a second valve 76 that seals the second opening. Further, the ink cartridge includes a biasing member (spring) 75 that is connected to the first valve 74 and the second valve 76 and biases the first valve 74 and the second valve 76. Since the ink cartridge according to the present exemplary embodiment has such a configuration, then in a case where either one of the first valve 74 and the second valve 76 moves to a direction to release the opening sealed by the valve, the spring 75 is compressed. Thus, the load of the spring 75 applied to the other valve further increases, whereby it is possible to increase the sealing properties on the other valve side. For example, as illustrated in FIG. 7A, suppose that due to the impact of the dropping of the ink cartridge 20 or the collision of a projection, the first valve 74 moves to the housing 70 side (in the direction of a white arrow) and releases the insertion portion 24 of the joint member 73. Even in this case, the sealing properties of the second valve 76 further increase. Thus, the flow of ink into the ink supply portion 73*a* from the housing 70 side is reduced, whereby it is possible to reduce the leakage of ink inside the ink cartridge 20 to outside the ink cartridge 20.

Figure 7B:
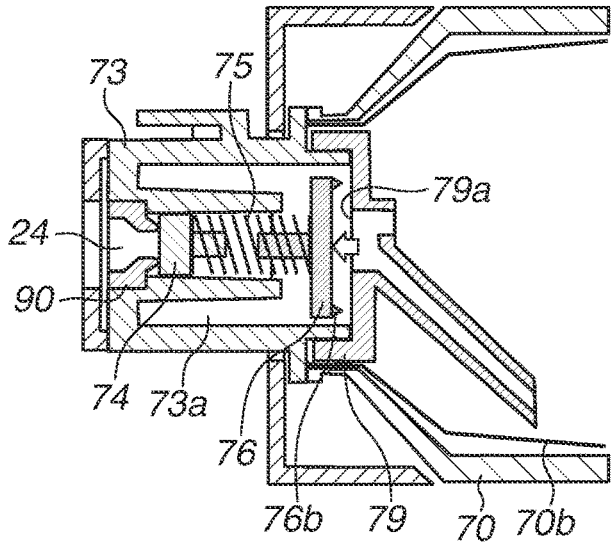

Conversely, as illustrated in FIG. 7B, even if the inside of the housing 70 is pressurized by the dropping of the ink cartridge 20 or other causes and the second valve 76 moves to the insertion portion 24 side and releases the flow path opening 79*a*, the sealing properties of the first valve 74 further increase. Thus, it is possible to reduce ink leakage to outside. In this sealing configuration, ink leakage to outside is reduced even when the ink cartridge 20 is impacted.

To simultaneously obtain sufficient sealing effects in the first valve 74 and the second valve 76, it is desirable that the load applied to the spring 75 in the state where the ink cartridge 20 is present alone (the state where the ink cartridge 20 is not attached to the recording apparatus 1) should be 2 newtons (N) or more and 3 N or less. Further, to reduce the burden on the user, it is desirable that the load applied to the spring 75 when the ink cartridge 20 is attached to the recording apparatus 1 should be 5 N or more and 6 N or less.

Figure 7C:
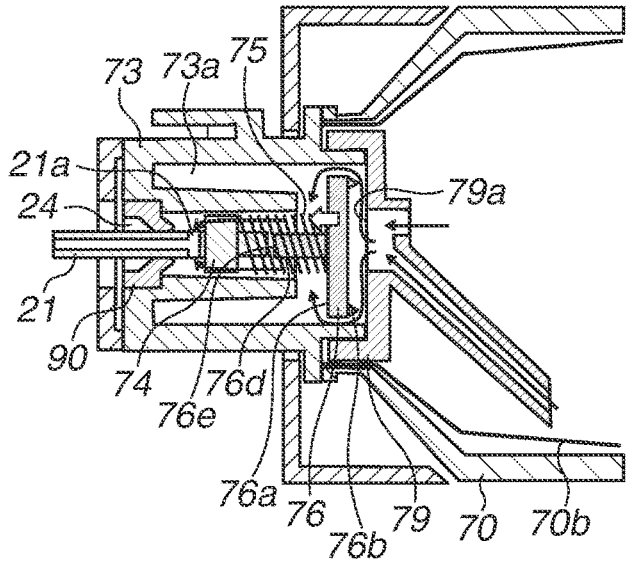

FIG. 7C illustrates the state where ink in the housing 70 is supplied from the ink cartridge 20 to the recording apparatus 1. If the ink cartridge 20 is attached to the recording apparatus 1, the ink reception tube 21 is inserted into the ink supply portion 73*a* through the insertion portion 24 of the joint member 73, and the first valve 74 moves to the housing 70 side by the ink reception tube 21 and separates from the sealing portion 90. Then, an opening 21*a* of the ink reception tube 21 communicates with the ink supply portion 73*a*. Then, the inside of the ink supply portion 73*a* is depressurized by the ink reception tube 21, and the second valve 76 moves to the insertion portion 24 side. In this manner, the ink in the housing 70 becomes able to flow into the ink supply portion 73*a* through the flow path opening 79*a*, and the ink in the housing 70 is supplied to the recording apparatus 1 via the ink reception tube 21. The ink flows in directions indicated by solid arrows in FIG. 7C. That is, in this sealing configuration, when the ink cartridge 20 is present alone, the sealing properties at a supply port (the first opening) are high, and when the ink cartridge 20 is attached to the recording apparatus 1, the supply port is easy to open.

Figure 8:
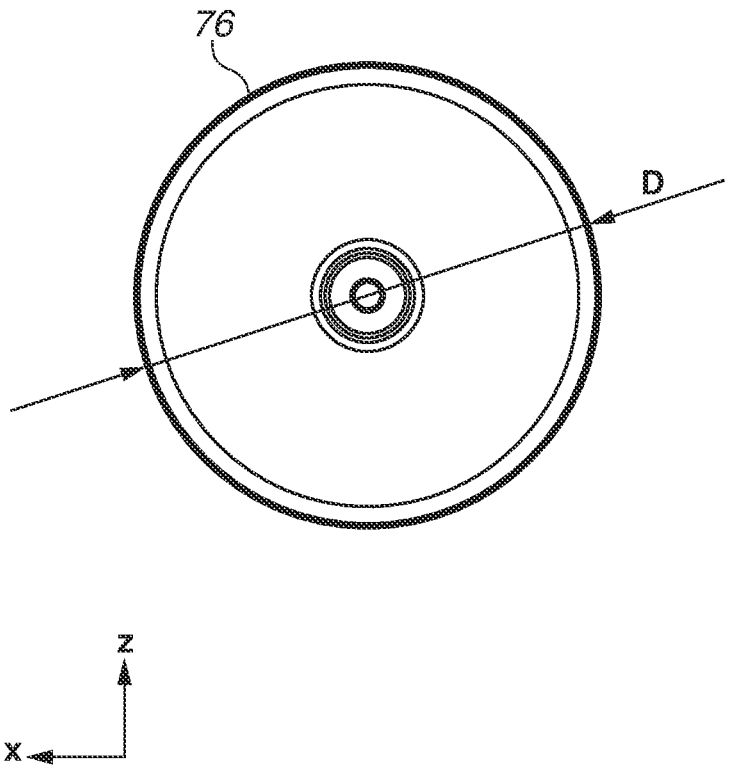
FIG. 8 is a diagram illustrating the second valve.

FIG. 8 illustrates a diagram of the second valve 76 viewed from the direction of an arrow in FIG. 6A (a-y-direction in FIGS. 5A to 5C). It is desirable that the area of a circle calculated with an outermost diameter D of the second valve 76 illustrated in FIG. 8 should be 200 $mm^2$ or more and 400 $mm^2$ or less. Based on this range, if the load applied to the spring 75 when the ink cartridge 20 is attached to the recording apparatus 1 is 5 N or more and 6 N or less, and in a case where the ink supply portion 73*a* is depressurized when ink is supplied to the recording apparatus 1, it is possible to easily release the second valve 76.

A second exemplary embodiment is described with a focus on the differences from the first exemplary embodiment. FIG. 9A illustrates a cross-sectional view of an ink cartridge according to the second exemplary embodiment. The ink cartridge is in the state where the cover member is not attached to the ink cartridge. FIG. 9B illustrates an enlarged view of a portion indicated by C in FIG. 9A. To represent the orientation of the ink cartridge when subjected to an air removal process described below, FIG. 9B illustrates the insertion portion 24 of the joint member 73 to be on the upper side.

In a case where the initial filling amount of ink in the same container is changed according to the usage pattern of the user, if a filling amount is small, the proportion of air in the housing 70 becomes high. Thus, there is a possibility that when the ink cartridge is left under high temperature, the inner pressure of the housing 70 increases, and the housing 70 deforms. However, as described in the first exemplary embodiment, the housing 70 has a two-layer structure and the inner layer 70*b* is formed of a flexible material, whereby it is possible to remove air to the extent that the inside of the housing 70 is not pressurized even under high temperature.

Figure 9C:
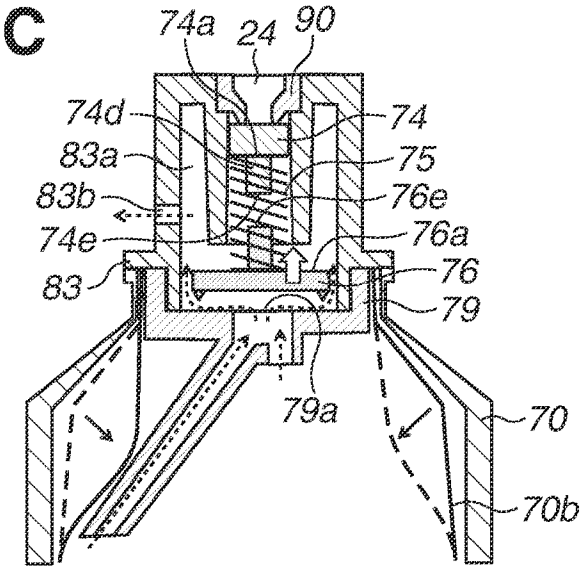
FIGS. 9A, 9B, 9C, and 9D are cross-sectional views of an ink cartridge.
Figure 9D:
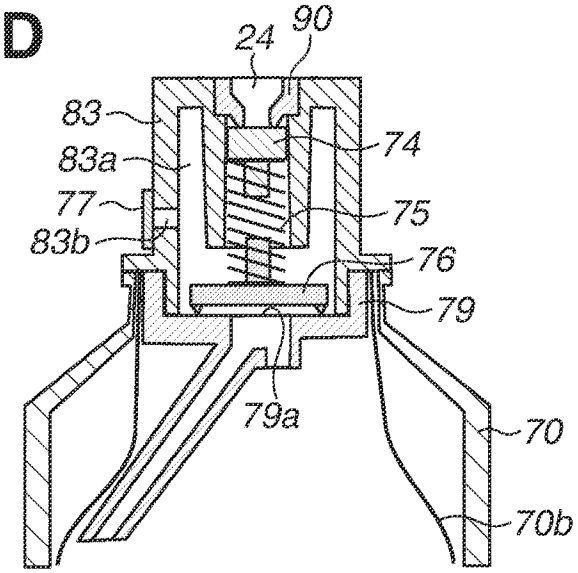
Figure 9A:
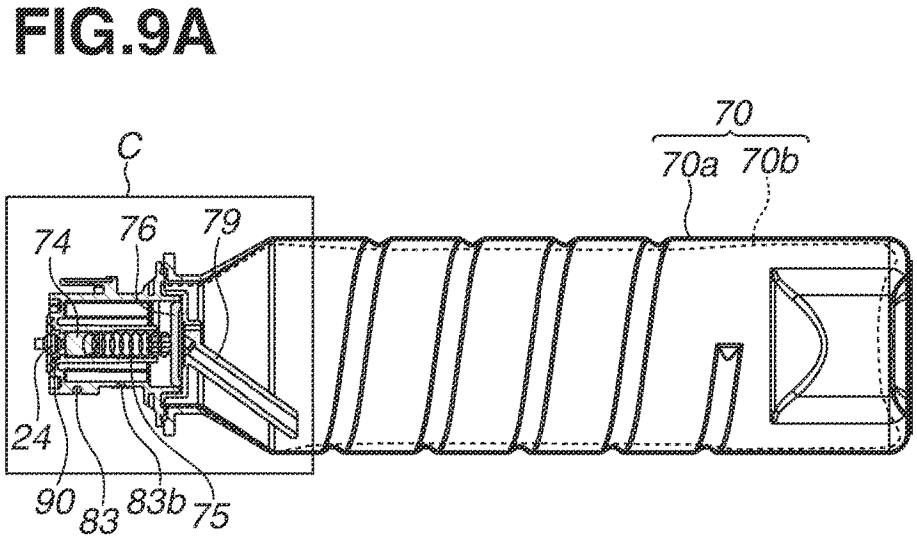
Figure 9B:
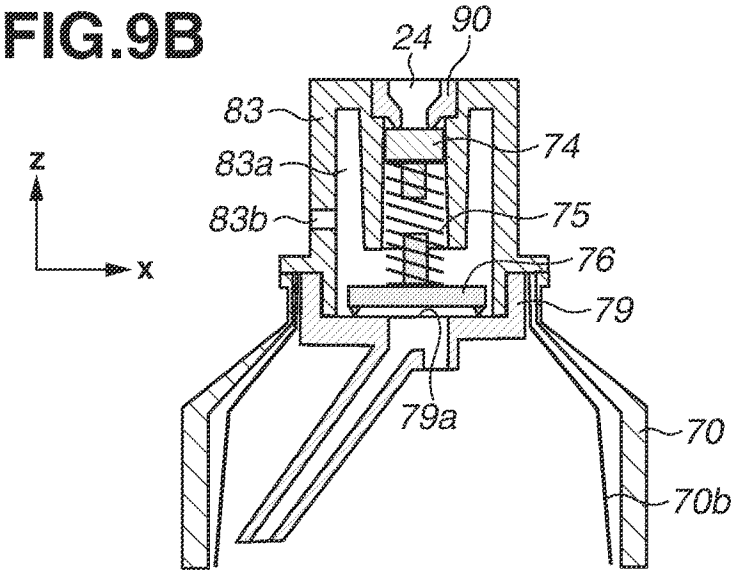
Figure 10:
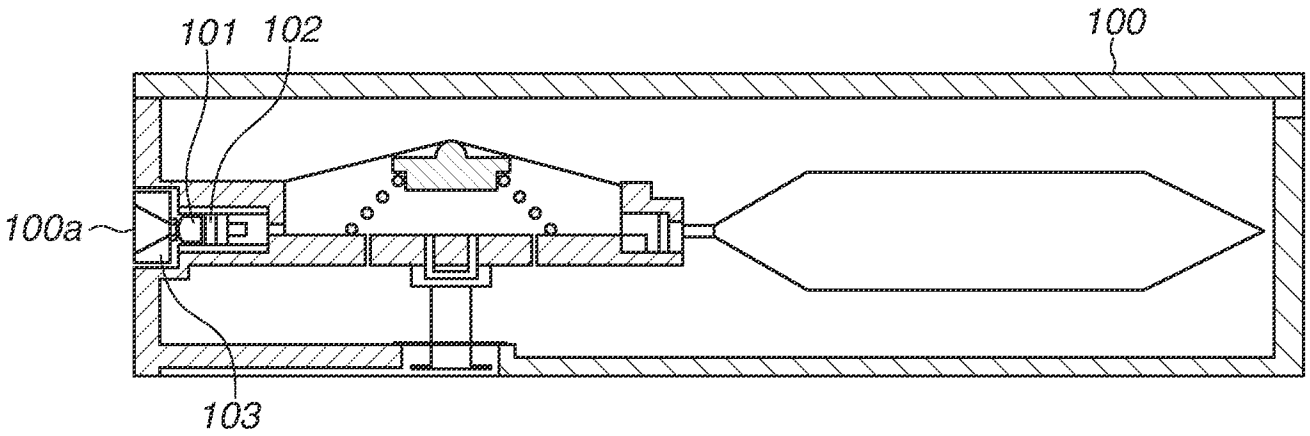
FIG. 10 is a diagram illustrating an ink cartridge.

FIGS. 9C and 9D schematically illustrate the state where an air removal process is performed on the ink cartridge illustrated in FIGS. 9A and 9B. In the air removal process, to remove only air in the housing 70, it is desirable that the ink cartridge should be oriented vertically along the vertical direction. As described in the first exemplary embodiment, a space formed by a joint member 83 and the flow path member 79 is an ink supply portion 83*a*. In the joint member 83, an air vent port 83*b* is provided, which can cause the ink supply portion 83*a* as the inside, to communicate with the outside. The air vent port 83*b* is an opening different from the first and second openings. In the process of manufacturing the ink cartridge, the housing 70 is filled with ink, then, the joint member 83 joined to the flow path member 79 is joined to the housing 70, and then, air in the inner layer 70*b*, which is an ink storage portion of the housing 70, is removed.

In the air removal process, first, air is suctioned through the air vent port 83*b*, thereby depressurizing the inside of the ink supply portion 83*a*. Consequently, the second valve 76, which functions as an air backflow check valve, moves to the insertion portion 24 side (in the direction of a white arrow in FIG. 9C) and releases the flow path opening 79*a*, and the inside of the housing 70 and the ink supply portion 83*a* communicate with each other. Then, air is further suctioned, whereby it is possible to remove air in the inner layer 70*b* through the air vent port 83*b* (indicated by a dashed arrow in FIG. 9C). At this time, the inner layer 70*b* deforms in the directions of contraction as indicated by solid arrows in FIG. 9C according to the amount of the removed air.

In this case, the surface of the first valve 74 on the side where the first valve 74 is connected to the spring 75 (the surface on a supporting portion 74*d* side) is a spring connection surface 74*e* of the first valve 74. In the air removal process, it is necessary to move only the second valve 76. Thus, it is desirable that the area of the surface (spring connection surface) 76*a* of the second valve 76 on the side where the second valve 76 is connected to the spring 75 should be larger than the area of the spring connection surface 74*a* of the first valve 74. Specifically, it is desirable that the area of the spring connection surface 76*a* of the second valve 76 should be greater than or equal to 8 times and less than or equal to 18 times the area of the spring connection surface 74*a* of the first valve 74. In a case where each valve includes a spring supporting portion, the upper surface of the spring supporting portion may be considered as included in the spring connection surface.

Further, at this time, the second valve 76 moves to the insertion portion 24 side. Thus, the spring 75 is compressed, and the sealing properties of the insertion portion 24 by the first valve 74 further increase. This reduces the entry of air into the ink supply portion 83*a* through the insertion portion 24 (the first opening), whereby it is possible to efficiently suction only air in the housing 70. Further, as illustrated in FIG. 9D, after the air removal process, the air vent port 83*b* is sealed by welding a film 77. At this time, during the air removal process and the film welding process, the depressurization in the ink supply portion 83*a* is terminated, and the second valve 76 is biased again to the flow path member 79 side as illustrated in FIG. 9D. Consequently, the flow path opening 79*a* is closed against the ink supply portion 83*a*, whereby the backflow of air to the housing 70 side is reduced.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-008173, filed Jan. 22, 2018, which is hereby incorporated by reference herein in its entirety.

What is claimed is:

1. An ink cartridge storing ink inside the ink cartridge, comprising:

an ink flow path extending from the inside where the ink is stored to outside of the ink cartridge, wherein the ink flow path includes:

a first opening that opens toward the outside;

a second opening that opens to an opposite side of the first opening and opens toward the inside of the ink cartridge;

a first valve configured to seal the first opening from the inside toward the outside of the ink cartridge;

a second valve configured to seal the second opening; and a biasing member configured to bias the first valve toward the first opening and the second valves toward the second opening, the first valve and the second valve being independently capable of releasing and sealing the first opening and the second opening, respectively.

2. The ink cartridge according to claim 1, further comprising:

a housing; and a joint member joined to the housing, wherein the ink flow path is provided in the joint member.

3. The ink cartridge according to claim 2, wherein the housing includes an inner layer and an outer layer that has stiffness higher than the inner layer.

4. The ink cartridge according to claim 1, wherein the biasing member is a spring.

5. The ink cartridge according to claim 1, wherein the second valve includes a lip on a surface of a side opposite to a surface of a side on which the second valve is connected to the biasing member.

6. The ink cartridge according to claim 1, wherein on a surface of the second valve on a side where the second valve is connected to the biasing member, the second valve includes a supporting portion configured to support the biasing member and a rib extending from the supporting portion to an outer periphery of the second valve.

7. The ink cartridge according to claim 6, wherein a plurality of the ribs are provided, radially extending from the supporting portion.

8. The ink cartridge according to claim 1, wherein a load applied to the biasing member in a state where the ink cartridge is present alone is 2 newtons or more and 3 newtons or less.

9. The ink cartridge according to claim 1, wherein a load applied to the biasing member when the ink cartridge is attached to a recording apparatus is 5 newtons or more and 6 newtons or less.

10. The ink cartridge according to claim 1, wherein the ink flow path further includes an opening different from the first and second openings and configured to enable the inside and the outside of the ink cartridge to communicate with each other.

11. The ink cartridge according to claim 10, wherein the different opening is sealed by welding a film.

12. The ink cartridge according to claim 10, wherein the different opening is an air vent port for removing air from the inside.

13. The ink cartridge according to claim 1, wherein an area of a surface of the second valve on a side where the second valve is connected to the biasing member is larger than an area of a surface of the first valve on a side where the first valve is connected to the biasing member.

* * * * *